United States Patent [19]

Yamamoto

[11] Patent Number: 4,852,808

[45] Date of Patent: Aug. 1, 1989

[54] FUEL INJECTION VALVE USED IN FUEL INJECTION APPARATUS FOR INTERNAL COMBUSTION ENGINE

[75] Inventor: Yoshihisa Yamamoto, Kariya, Japan

[73] Assignee: Nippondenso Co., Ltd., Kariya, Japan

[21] Appl. No.: 128,399

[22] Filed: Dec. 3, 1987

[30] Foreign Application Priority Data

Dec. 5, 1986 [JP] Japan ..... 61-290946

[51] Int. Cl.[4] ..... F02M 45/00

[52] U.S. Cl. ..... 239/533.3; 239/533.8

[58] Field of Search ..... 239/88–96, 239/533.3–533.12

[56] References Cited

U.S. PATENT DOCUMENTS

| | | | |
|---|---|---|---|
| 3,910,503 | 10/1975 | Barber | 239/533.8 |
| 4,165,724 | 8/1979 | Yamamoto et al. | 123/139 AT |
| 4,167,168 | 9/1979 | Yamamoto | 123/139 AT |
| 4,402,456 | 9/1983 | Schneider | 239/90 |
| 4,427,152 | 1/1984 | Sisson et al. | 239/90 |
| 4,448,356 | 5/1984 | Nakajima | 239/533.5 |
| 4,544,097 | 10/1980 | Aoki et al. | 239/533.2 X |
| 4,566,635 | 1/1986 | Trachte | 239/533.9 X |
| 4,669,668 | 6/1987 | Ogawa | 239/533.9 X |
| 4,684,067 | 8/1987 | Cotter et al. | 239/533.3 |

FOREIGN PATENT DOCUMENTS

| | | | |
|---|---|---|---|
| 59-48302 | 11/1984 | Japan . | |
| 60-60032 | 12/1985 | Japan . | |
| 163396 | 3/1958 | Sweden | 239/533.3 |

OTHER PUBLICATIONS

Society of Automotive Engineers, Inc. "UFIS—A New Diesel Injection System"-J. A. Kimberley and R. A. DiDomenico, Feb. 28–Mar. 4, 1977, No. 770084.

*Primary Examiner*—Andres Kashnikow
*Assistant Examiner*—Kevin P. Weldon
*Attorney, Agent, or Firm*—Cushman, Darby & Cushman

[57] ABSTRACT

A fuel injection valve for injecting into a combustion chamber of an internal combustion engine, comprises a valve housing with a fuel inlet and nozzle portion having an injection opening, a first fuel passage for communicating the nozzle portion with the fuel inlet, a first needle valve element for opening and closing the injection opening, a first spring for urging the first needle valve element to close the first fuel passage, a pin disposed for providing an axial gap between the first needle valve element and itself, a second pin urging the pin towards the first needle valve element, a second fuel passage for communicating the back pressure chamber with the fuel inlet, an ON-OFF valve for opening and closing the fuel passage, a drain passage for communicating the back pressure chamber to a lower pressure than that of the back pressure chamber and an orifice disposed in the drain passage.

13 Claims, 3 Drawing Sheets

FUEL INJECTION VALVE USED IN FUEL INJECTION APPARATUS FOR INTERNAL COMBUSTION ENGINE

RELATED APPLICATIONS

The following list of U.S. patents, applications and publications are cited as containing similar subject matter to this application.

U.S. Pat. Nos. 4,165,724; 4,167,168; 4,402,456 and 4,427, 152 Japanese examined publication Nos. 59-48302 and 60-60032

SAE Paper 770084

U.S Appln. of YAMAMOTO—Ser. No. 36,901.

The present invention relates to a fuel injection valve used in a fuel injection apparatus for an internal combustion engine.

Normally, a fuel injection valve opens when the fuel pressure which is applied to the pressure receiving area of a needle valve element thereof rises above a preset load of a spring. The valve closes when the pressure falls below the preset load.

To satisfy the recent requirements for minimizing exhaust gases and reducing fuel consumption, it has been found that it is desirable that a rate of injection slowly increases early in a fuel injection cycle and rapidly decreases near the end of a fuel injection cycle and that a pilot fuel injection be performd at a low engine speed.

As shown in, e.g., Japanese Patent Examined Publication No. 59-48302, there is known an injector in which a back pressure chamber is provided in association with a needle valve element. The motion of the needle valve element is controlled by hydraulic pressure in the back pressure chamber. However, in such a device, a hydraulic pressure source must be provided. It is possible to obtain only a slow increase in fuel injection rate during an injection cycle.

It is desireable for various reasons to be able to accurately control the injection rate so as to be different at various times in a fuel injection cycle. More specifically, it is desireable to be able to provide a pilot fuel injection (a short burst of fuel) and a changeable injection rate during an injection cycle. This cycle includes a slow rise in injection rate near the beginning of an injection cycle and a rapid shut off of injection (rapid fall of injection rate) near the end of the cycle.

According to another known arrangement, it is possible to obtain only an instantaneous decrease in fuel injection rate at the end of a fuel injection cycle.

According to still another known arrangement, there is provided an injector that purports to slowly increase the fuel injection rate early in a fuel injection cycle and instantaneously reduce the fuel injection rate at end of the fuel injection cycle. However, it does not effectively accomplish its purpose and it does not provide a pilot fuel injection. In the low rational speed range of an engine, the abnormal injection and the fluctuation of the fuel injection occurred due to the increase in pressure of the residual fuel in the back pressure chamber.

It has, until the present invention, seemed to not be possible to provide an injector capable of providing a pilot fuel injection and a changeable injection rate including a slow rise in injection rate at the beginning of an injection cycle and a rapid shut off of injection at the end of the cycle.

SUMMARY OF THE INVENTION

It is an object of the present invention to provide a fuel injection valve of a simple constitution which can simultaneously accomplish both of a slow increase in the fuel injection rate early in an injection cycle and substantially instantaneously shut off fuel injection (drop the injection rate rapidly) near the end of the injection cycle, and which can also perform a pilot fuel injection over the whole rotational speed range of an engine or at least over a predetermined range of rotational speed.

It is another object of the present invention to prevent the occurrence of the abnormal injection and the fluctuation of the fuel injection due to the increase in pressure of the residual fuel in the back pressure chamber in the low rotational speed range.

To this end, the present invention provides a fuel injection valve comprising a valve housing having a nozzle portion which has an injection opening for injecting fuel into the combustion chamber and defining a fuel inlet for receiving pressurized fuel, means for defining a first fuel passage communicating the nozzle portion with the fuel inlet, a first needle valve element slidably disposed in the valve housing for applying pressure to the first needle valve element, a pin device disposed in the valve housing for providing an axial gap between the pin device and an end portion of the first needle valve element, a second spring disposed in the valve housing for urging the pin device element, a second spring disposed in the valve housing for urging the pin device towards the first needle valve element, back pressure chamber means formed in the valve housing for applying to the first valve element, means for defining a second fuel passage for communicating the back pressure chamber means with the fuel inlet, an ON-OFF valve means for opening and closing the second fuel passage, means for defining a drain passage for communicating the back pressure chamber means to a lower pressure than that of the back pressure chamber means and for relieving at least some of the pressure from the back pressure chamber after an injection of fuel and orifice means disposed in the drain passage.

DETAILED DESCRIPTION OF THE PREFERRED EMBODIMENTS

Figure 1:
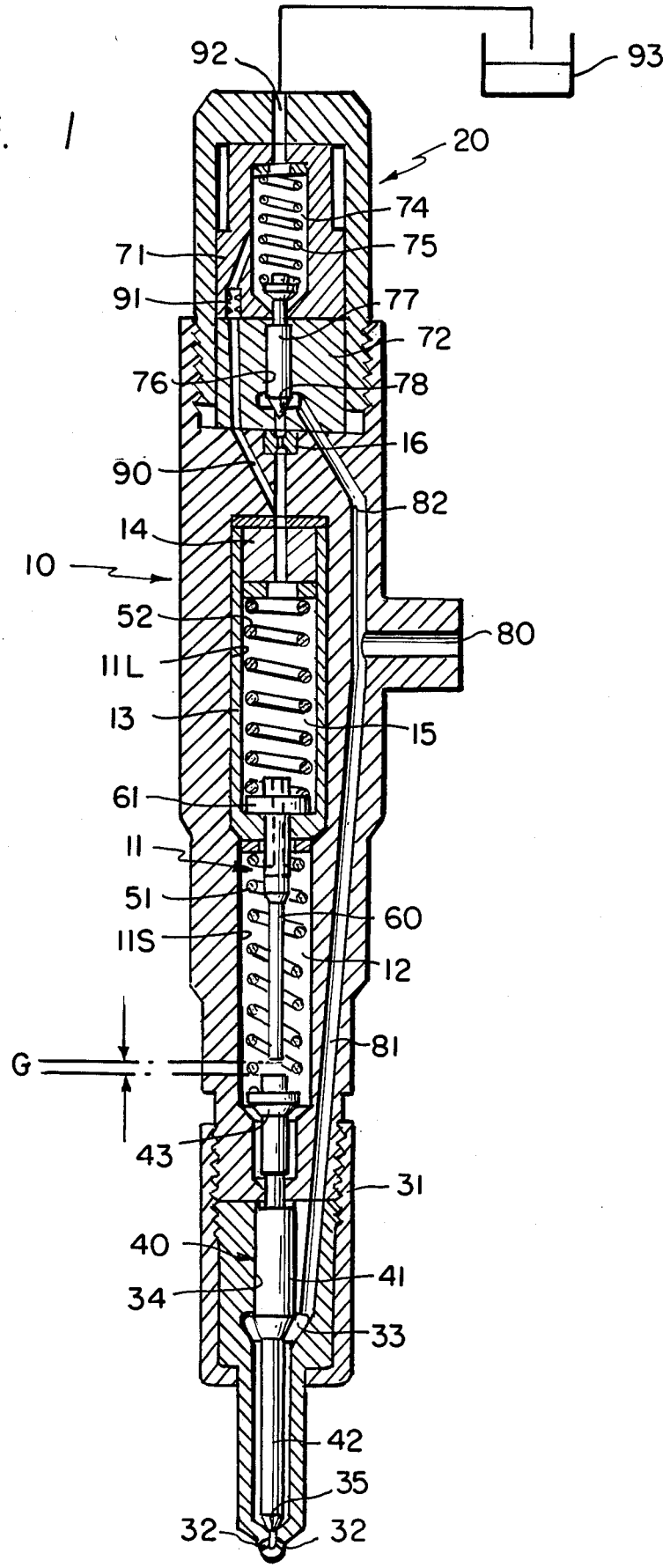
FIG. 1 shows a vertical sectional view of a valve according to a first embodiment of the present invention.

FIG. 1 shows a vertical sectional view of a valve according to a first embodiment of the present invention. A fuel injection valve 1 has a tapered valve housing 10, a head cap 20 which is screw mounted to an enlarged end portion of the valve housing 10, and an end nozzle 30 which is coupled to a tapered end of the valve housing 10 by a mounting sleeve 31. A needle valve element 40 is disposed in the fuel injection valve 1. The needle valve element 40 has a large diameter portion 41, a small diameter portion 42 coupled with one end portion of the large diameter portion 41, and a flared tail end portion 43 which is screw mounted to the other end portion of the large diameter portion 41.

Injection openings 32, 32 and a pressurized fuel chamber 33 are formed in the end nozzle 30. Further, a bore 34 is formed in the end of nozzle 30. The large diameter portion 41 of the needle valve element 40 oil-hermetically slides through the bore 34. The injection openings 32, 32 and the pressurized fuel chamber 33 ar communicated or not communicated with each other depending on whether or not the end portion of the small diameter portion 42 of the needle valve element 40 is seated on a seat 35 of the nozzle 30.

The valve housing 10 is formed with a bore 11 having a large diameter portion 11L forming a first back pressure chamber 15 and a small diameter portion 11S coupled with the large diameter portion 11L. A sleeve 13 is inserted into the large diameter portion 11L. A first compression spring 51 is disposed between a tapered end of the sleeve 13 and a flared end of the needle valve element 40. A preset load is applied to the needle valve element 40 by the first compression spring 51. A pin 60 is arranged in the bore 11, which is provided at one end thereof with a flange 61. At the flange 61, the pin 60 is urged with a preset load by a second compression spring 52 in a second back pressure chamber 15 which is defined by the sleeve 13 and an adjusting member 14. The preset load can be adjusted by changing the length of adjusting member 14. Thus, the flange 61 is seated onto the end of the sleeve 13 and the other end portion of the pin 60 is projected into the small diameter portion 11S of the bore 11 so as to provide a predetermined gap G between the other end portion of the pin 60 and the flared end of the needle valve element 40 on the seat 35.

An ON-OFF valve 70 is disposed in the head cap 20. The ON-OFF valve 70 has a first valve housing half 71 and a second valve housing half 72 coupled with the first valve housing half 71. A third compression spring 75 is disposed in a cavity 74 formed in the first valve housing half 71. The compression spring 75 urges a needle valve element 77 at one end thereof, with a preset load. The needle valve element 77 oil-hermetically slides in a bore 76. The bore 76 is formed in the second valve housing half 72. Thus, a tapered end of the needle valve element 77 is seated to a seat 78 formed on the second valve housing half 72, thereby closing the ON-OFF valve 70.

The fuel injection valve 1 is formed with a first fuel passage 81 and a second fuel passage 82. The first fuel passage 81 communicates a fuel inlet 80 for receiving the fuel pumped from a fuel injection pump (not shown) with the pressurized fuel chamber 33 so as to supply the fuel into an engine cylinder (not shown). The second fuel passage 82 communicates the fuel inlet 80 with the back pressure chambers 15 and 12 through the ON-OFF valve 70 and an orifice 16 formed in the adjusting member 14. The cavity 74 is communicated with the back pressure chamber 15 through a communicating passage 90. A second orifice 91 is disposed in the communicating pressure level said (e.g. a fuel tank 93) through a drain passage 92.

The operation of the first embodiment will now be explained. A part of the fuel pumped from the fuel pump (not shown) through the fuel inlet 80 flows through the second fuel passage 82 to the ON-OFF valve 70. The remaining fuel flows through the firstfuel passage 81 into the pressurized fuel chamber 33. In association with the increase in pressure of the fuel, when this pressure has reached a first valve opening pressure (which is determined by the load of the first compression spring 51 and the fuel pressure applied to the needle valve element 40) of the fuel injection valve 1 (time A in FIG. 2), the needle valve element 40 is away from the seat 35 against the spring 51, thereby opening the fuel injection valve 1.

Figure 2:
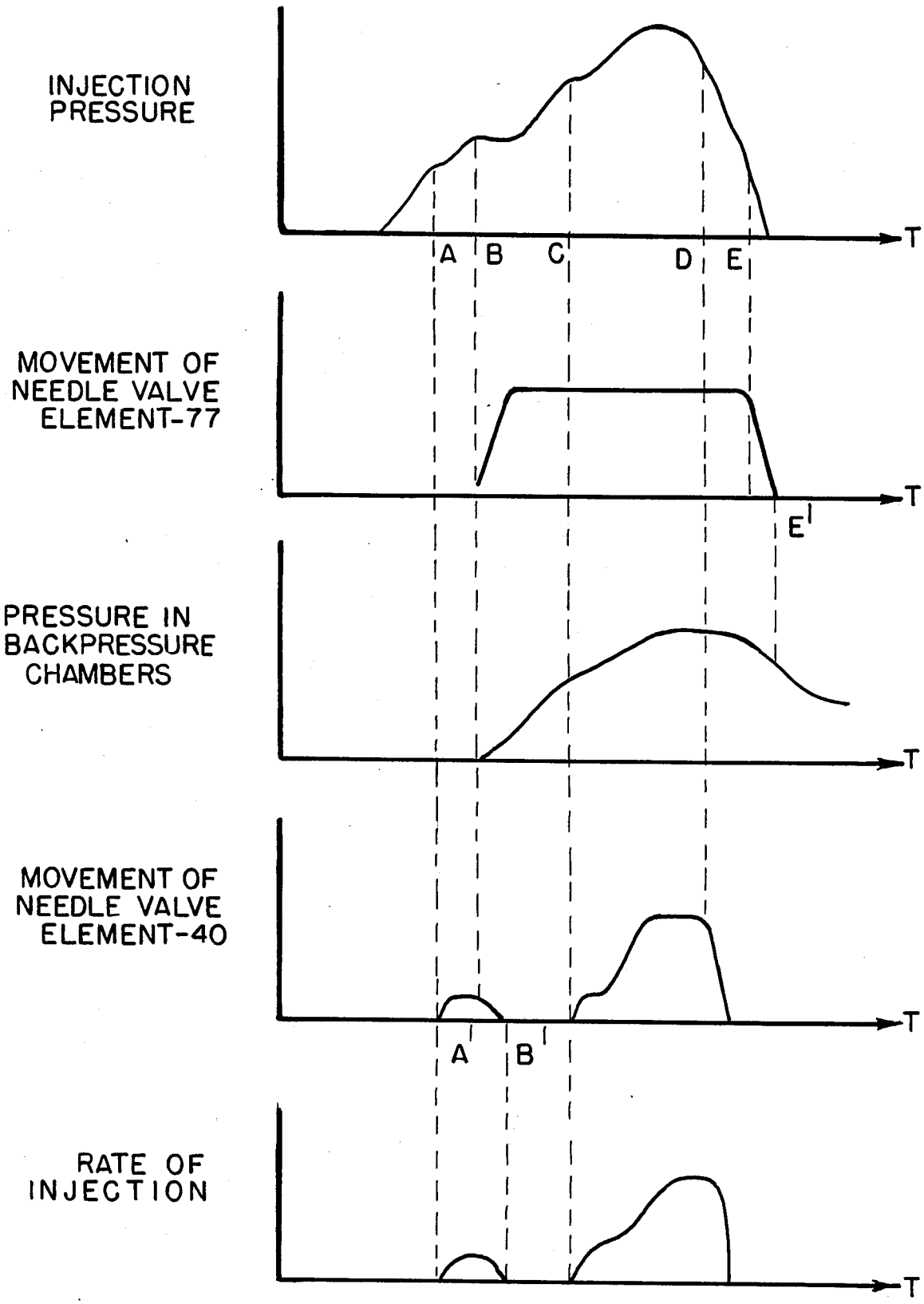
FIG. 2 includes time charts showing various characteristics of the valve shown in FIG. 1.

When the needle valve element 40 is moved away from the seat 35 by a distance of the preset gap G, it comes into contact with the pin 60 and stops (time A' in FIG. 2). Since the fuel injection valve 1 is open in this state, the fuel is injected into the engine cylinder. However, since the needle valve element 40 moves by the distance of the gap G, the opening degree of the first fuel passage 81 is small and the fuel pumping pressure is also still small, so that the fuel injection rate is small.

Subsequently, when the fuel is further pumped, the fuel pressures in the fuel passages 81 and 82 increase because the opening degree of the passage 81 is small. On the other hand, when the fuel pressure has reached a valve opening pressure (which is determined by the set load of the third compression spring 75 and the fuel pressure applied to the needle valve element 77) of the oN-oFF valve 70. The needle valve element 77 is unseated from seat 78 against the spring 75, thereby opening the ON-OFF valve 70 (time B in FIG. 2). Thus, a part of the fuel from the second fuel passage 82 flows through the orifice 16 into the second back pressure chamber 15. Since the second back pressure chamber 15 is communicated with the first back pressure chamber 12, the fuel also flows into the first chamber 12, so that the pressures in the chambers 12 and 15 are equalized.

At this time, a force, which is equal to the product of the pressure in the back pressure chambers 12 and 15 and the cross sectional area of the flared end of the needle valve element 40, acts on the needle valve element 40 so as to close the fuel injection valve 1. Consequently, the needle valve element 40 seats on seat 35 and the fuel injection valve 1 is closed (time B' in FIG. 2) and the fuel injection is temporarily stopped.

Since the fuel injection valve 1 is closed, the fuel pressure in the first and the second fuel passages 81 and 82 further increases. When this fuel pressure has exceeded the resultant force of the pressing force of the first compression spring 51 and the force by the fuel pressure in the first chamber 12, namely, when it has exceeded the second opening pressure (which has already been higher than the first one) (time C in FIG. 2), the needle valve element 40 is again removed from the seat 35, so that the fuel injection valve 1 is opened again to restart the fuel injection.

When the fuel pressure further increases, since the ON-OFF valve 70 has already been open, the increased pressure compresses the spring 51 and also compresses the spring 52. Thus, the main fuel injection is executed. After the fuel injection of a determined amount was subsequently executed, the fuel which is supplied is reduced and the pressure in the fuel passages 81 and 82 decreases. At this time, since the orifice 16 is provided, the pressure in the back pressure chambers 12 and 15 decreases slower than the pressure in the fuel passages 81 and 82, so that the pressure in the back pressure chamber is always higher than that in the passages 81 and 82. This pressure difference is adjusted by the orifice 16.

Since the force to close the valve 1 due to the resultant force of the force by the pressure difference and the spring forces of the springs 51 and 52 is extremely enlarged (i.e., the valve closing pressure rises), the needle valve element 40 is promptly put on the seat 35, thereby closing the fuel injection valve 1 (time D in FIG. 2).

When the pressure further decreases, the ON-OFF valve 70 is also closed (time E to E' in FIG. 2) and the valve 1 enters the state as shown in FIG. 1. At this time, the fuel is still left in the back pressure chambers 12 and 15. However, the fuel having the reduced pressure flows into the low pressure level side, the fuel tank 93 through the communicating passage 90, the second orifice 91, the cavity 74 and the drain passage 92. The pressure of the back pressure 12 and 15 is returned to the low pressure level until the next fuel injection is executed. Subsequently, it is possible to prevent the occurrence of the abnormal injection and the fluctuation of the fuel injection due to the increase in pressure of the residual fuel in the back pressure chamber 12 and 15.

Although the fuel flowing into the back pressure chamber 12 and 15 make the pressure increase, the fuel in the back chamber 12 and 15 also flows into the fuel tank 93 through the communicating passage 90, the orifice 91, the cavity 74 and the drain passage 92. However, the cross sectional area of the orifice 91 is set to be small (about 0.05 mm2), the fuel amount flowing through the drain passage 92 is so small that an influence is hardly exerted.

In some engines, there is a case where it is sufficient to merely reduce the fuel injection rate early in the fuel injection cycle without the need of using a pilot injection. In this case, the fuel injection valve of the invention can be also used as it is. In such a case, for example, by setting the valve opening pressure of the ON-OFF valve 70 to be higher than the third valve opening pressure which is determined by the second spring 52, and by opening the fuel injection valve 1 after the needle valve element 40 is fully removed from the seat 35, the purpose of such case can be accomplished. In this case, the fuel injection valve 1 is not closed during the fuel injection, so that no pilot injection takes place. However, since the needle valve element 40 moves in a stepwise manner and the opening degree of the passage is small in the case of the movement of the needle valve element 40 in the first step, the injection rate can be slowly increased by reducing the injection rate early in the fuel injection cycle. At the same time, when the fuel injection valve 1 is closed, the pressures in the back pressure chambers 12 and 15 are increased by opening the ON-FF valve 70, so that the valve closing force increases, thereby enabling the valve 1 to be promptly closed.

On the other hand, in a single engine by adjusting the valve opening pressure of the ON-OFF valve 70 and the orifice 16, in the low rational speed range in which the injection rate of the fuel per unit time is small, the pilot injection can be performed, while in the high rotational speed range in which the injection rate is large, by reducing the pressures in the back pressure chambers so as not to temporarily close the fuel injection valve during the injection and by arranging the pressure of the fuel to be supplied higher than the pressures in the back pressure chambers, the pilot injection is not performed but the fuel injection can be executed with merely reduced injection rate early in the fuel injection cycle.

In the embodiments which will be explained hereinafter, the same parts and components that are identical to or analogous to corresponding parts in the previously described embodiment are not described. Where appropriate, the same reference numerals are used to designate like or corresponding parts.

Figure 3:
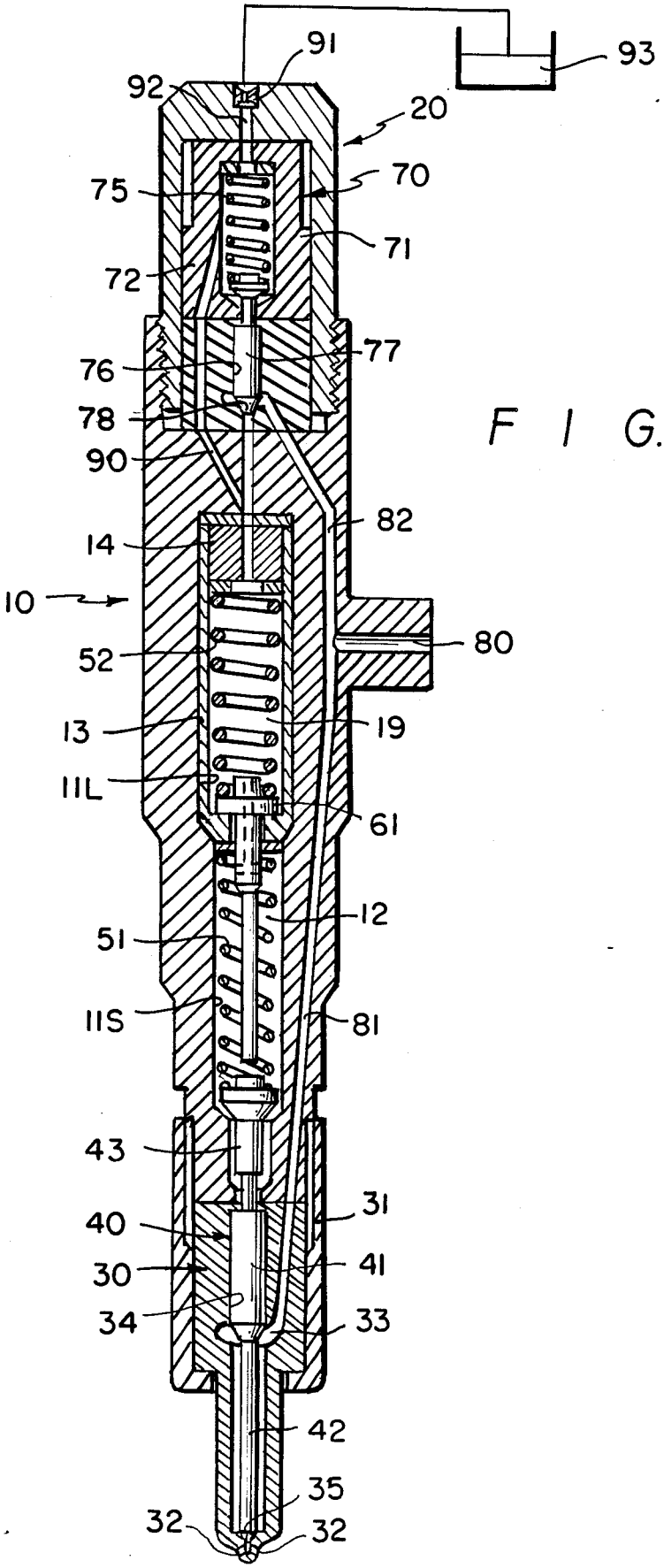
FIG. 3 shows a vertical sectional view of a valve according to a second embodiment of the present invention.

The second embodiment shown in FIG. 3 differs from the first embodiment with respect to the position of orifice 91. In the second embodiment, the orifice 91 is disposed in the drain passage 92. The fundamental operation of the second embodiment is substantially the same as that in the first embodiment and, accordingly, its description is omitted.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A fuel injection valve for injecting fuel into a combustion chamber of an internal combustion engine comprising:

a valve housing having a nozzle portion which has an injection opening for injecting fuel into said combustion chamber and defining a fuel inlet for receiving pressurized fuel;

means for defining a first fuel passage for communicating said nozzle portion with said fuel inlet;

a first needle valve element slidably disposed in said nozzle portion for opening and closing said injection opening;

a first spring disposed in said valve housing for applying pressure to said first needle valve element;

a pin device disposed in said valve housing providing an axial gap between said pin device and an end portion of said first needle valve element;

a second spring disposed in said valve housing for urging said pin device towards said first needle valve element;

back pressure chamber means formed in said valve housing for applying pressure to said first needle valve element;

means for defining a second fuel passage for communicating said back pressure chamber means with said fuel inlet;

an ON-OFF valve means for opening and closing said second fuel passage, said ON-OFF valve means being disposed separately from said back pressure chamber means and being arranged to operate independently of pressure of fuel in said back pressure chamber means;

means for defining a drain passage for communicating said back pressure chamber means to a lower pressure than that of said back pressure chamber means and for relieving at least some of the pressure from said back pressure chamber after an injection of fuel; and orifice means disposed in said drain passage.

2. A fuel injection valve according to claim 1, wherein said first and second springs are housed in said back pressure chamber means.

3. A fuel injection valve according to claim 1, wherein said ON-OFF valve means includes a second needle valve element for opening and closing said second fuel passage and a third spring for urging said second needle valve element to close said second fuel passage.

4. A fuel injection valve according to claim 1, wherein said second spring has a spring force that is greater than the spring force of said first spring.

5. A fuel injection valve according to claim 3, wherein said third spring is housed in a cavity formed in said valve housing.

6. A fuel injection valve according to claim 5, wherein said drain passage includes said cavity being maintained at said lower pressure.

7. A fuel injection valve according to claim 5, wherein said orifice means is located upstream of said cavity with respect to a flow direction of the drain fuel.

8. A fuel injection valve according to claim 3, wherein said third spring is separate from said second spring.

9. A fuel injection valve for injecting fuel into a combustion chamber of an internal combustion engine comprising:

a valve housing having a nozzle portion which has an injection opening for injecting fuel into said combustion chamber and defining a fuel inlet for receiving pressurized fuel;

means for defining a first fuel passage for communicating said nozzle portion with said fuel inlet;

a first needle valve element slidably disposed in said nozzle portion for opening and closing said injection opening;

a first spring disposed in said valve housing for applying pressure to said first needle valve element;

a pin device disposed in said valve housing providing an axial gap between said pin device and an end portion of said first needle valve element;

a second spring disposed in said valve housing for urging said pin device towards said first needle valve element;

back pressure chamber means formed in said valve housing for applying pressure to said first needle valve element;

means for defining a second fuel passage for communicating said back pressure chamber means with said fuel inlet;

an ON-OFf valve means for opening and closing said second fuel passage, said ON-OFF valve means including a valve element and a third spring for urging said valve element;

a cavity formed in said valve housing surrounding one side of said valve element of said ON-OFF valve;

means for defining a communicating passage for communicating said back pressure chamber means and said cavity;

means for defining a drain passage for communicating said cavity to a lower pressure than that of said back pressure chamber means and for relieving at least some of the pressure from said back pressure chamber means through said communicating passage and said cavity; and an orifice disposed in said communicating passage.

10. A fuel injection valve according to claim 9, wherein said first and second springs are housed in said back pressure chamber means.

11. A fuel injection valve according to claim 9, wherein said second spring has a spring force that is greater than the spring force of said first spring.

12. A fuel injection valve according to claim 9, wherein said third spring is housed in said cavity.

13. A fuel injection valve according to claim 9, wherein said third spring is separate from said second spring.

* * * * *